US009055834B2

(12) United States Patent
Zechini

(10) Patent No.: US 9,055,834 B2
(45) Date of Patent: Jun. 16, 2015

(54) ADJUSTABLE GARMENT HANGER

(71) Applicant: Deborah Fusco Zechini, Cary, NC (US)

(72) Inventor: Deborah Fusco Zechini, Cary, NC (US)

( * ) Notice: Subject to any disclaimer, the term of this patent is extended or adjusted under 35 U.S.C. 154(b) by 122 days.

(21) Appl. No.: 13/952,974

(22) Filed: Jul. 29, 2013

(65) Prior Publication Data

US 2015/0028066 A1 Jan. 29, 2015

(51) Int. Cl.

| | |
|---|---|
| ***A47G 25/40*** | (2006.01) |
| ***A47G 25/44*** | (2006.01) |
| *A47G 25/48* | (2006.01) |

(52) U.S. Cl.

CPC ..... *A47G 25/441* (2013.01); *A47G 25/44* (2013.01); *A47G 25/48* (2013.01)

(58) Field of Classification Search

CPC ..... A47G 25/00; A47G 25/4046; A47G 25/4056; A47G 25/4053; A47G 25/44; A47G 25/441; A47G 25/442; A47G 25/443; A47G 25/445; A47G 25/48; A47G 25/50; A47G 25/40; A47F 7/19; A41D 27/22

USPC ..... 223/89, 94

See application file for complete search history.

(56) References Cited

U.S. PATENT DOCUMENTS

| | | | | | |
|---|---|---|---|---|---|
| 2,283,530 | A | * | 5/1942 | Bohachef | 223/91 |
| 2,421,433 | A | | 6/1947 | Poole | |
| D156,953 | S | * | 1/1950 | Goetsch | D6/315 |
| D157,089 | S | * | 1/1950 | Saunders | D6/318 |
| 2,504,562 | A | * | 4/1950 | Melcher | 223/89 |
| 2,637,471 | A | * | 5/1953 | Goldschmidt et al. | 223/89 |
| 2,716,512 | A | * | 8/1955 | Needles | 223/89 |
| 2,774,526 | A | | 12/1956 | Rauer | |
| 2,814,426 | A | * | 11/1957 | Miller | 223/94 |
| 2,900,117 | A | * | 8/1959 | Veltry | 223/94 |
| 5,085,357 | A | * | 2/1992 | Chen | 223/89 |
| 5,476,199 | A | | 12/1995 | Halverson et al. | |
| 6,722,538 | B1 | | 4/2004 | Autry et al. | |
| 2012/0080460 | A1 | * | 4/2012 | Nance, Jr. | 223/94 |

FOREIGN PATENT DOCUMENTS

| | | |
|---|---|---|
| JP | 8-38334 | 2/1996 |
| JP | 9-103598 | 4/1997 |

* cited by examiner

*Primary Examiner* — Ismael Izaguirre

(74) *Attorney, Agent, or Firm* — James G. Passe; Passe Intellectual Property, LLC

(57) ABSTRACT

The present invention is an adjustable hanger which allows for using a single hanger to be utilized for multiple different sized clothes. The shoulders utilize a locking button system. In some embodiments spring or magnetic clips are used on the horizontal beam of the hanger.

2 Claims, 3 Drawing Sheets

ADJUSTABLE GARMENT HANGER

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to garment hangers. In particular, the present invention relates to a garment hanger of adjustable size.

2. Description of Related Art

The use of hangers to keep clothing garments neat and wrinkle free is widely used. While clothing comes in a wide variety of sizes and shapes hangers essentially come in a regular and child size offering no opportunity to size a hanger to the garment being hung. When hanging clothing with a shoulder such as shirts jackets blouses and coats, use of a mis-sized hanger can cause wrinkles and dimples in the fabric necessitating pressing or ironing the garment before use, the exact thing the hanger is designed to prevent.

Hangers are in most cases a single unitary device and as such hangers are cheap to produce and many people adapt to the one size fits all hangers because of cost and durability. There have been limited attempts to design an adjustable clothing hanger but they suffer from breakable parts like springs and have parts which must remained aligned. One example is in U.S. Pat. No. 6,722,538 which discloses spring loaded adjustability and a cloths bar with an adjustable rod which can snag and grab pants placed on the pants rod.

Clearly there is still a need to have a clothing hanger with an adjustable feature which overcomes the limitations of the present hangers.

BRIEF SUMMARY OF THE INVENTION

The present invention relates to the discovery that adjustable shoulders using a slot and button mechanism wherein the pants bar is split in the middle solves the above and other problems posed by prior art hangers.

Accordingly, in one embodiment of the invention there is an adjustable garment hanger comprising:

a) a yoke, having a left and right shoulder, each shoulder slotted along at least a portion of the length of each shoulder and adapted at intervals to receive a plurality of locking buttons;

b) a left and right hanger section, having an angled shoulder beam and a lower horizontal beam the angled shoulder beam having a series of locking buttons positioned at the same intervals as the adaptation in the yoke such that the shoulder beam can be placed in the slot and the buttons aligned with the receiving positions on the yoke to lock the shoulder in place wherein the angled beam can be positioned and locked at multiple positions by telescoping within the slot to adjust the length of the shoulder created by the yoke and hanger section;

c) wherein the length of the horizontal beam on each of the left and right hanger section is of a length such that when the created shoulder is at its shortest either do not touch or touch without deforming the horizontal nature of the horizontal beams; and d) a hook which depends from the yoke such that the hanger can be suspended from a horizontal closet rod.

DETAILED DESCRIPTION OF THE INVENTION

Figure 1:
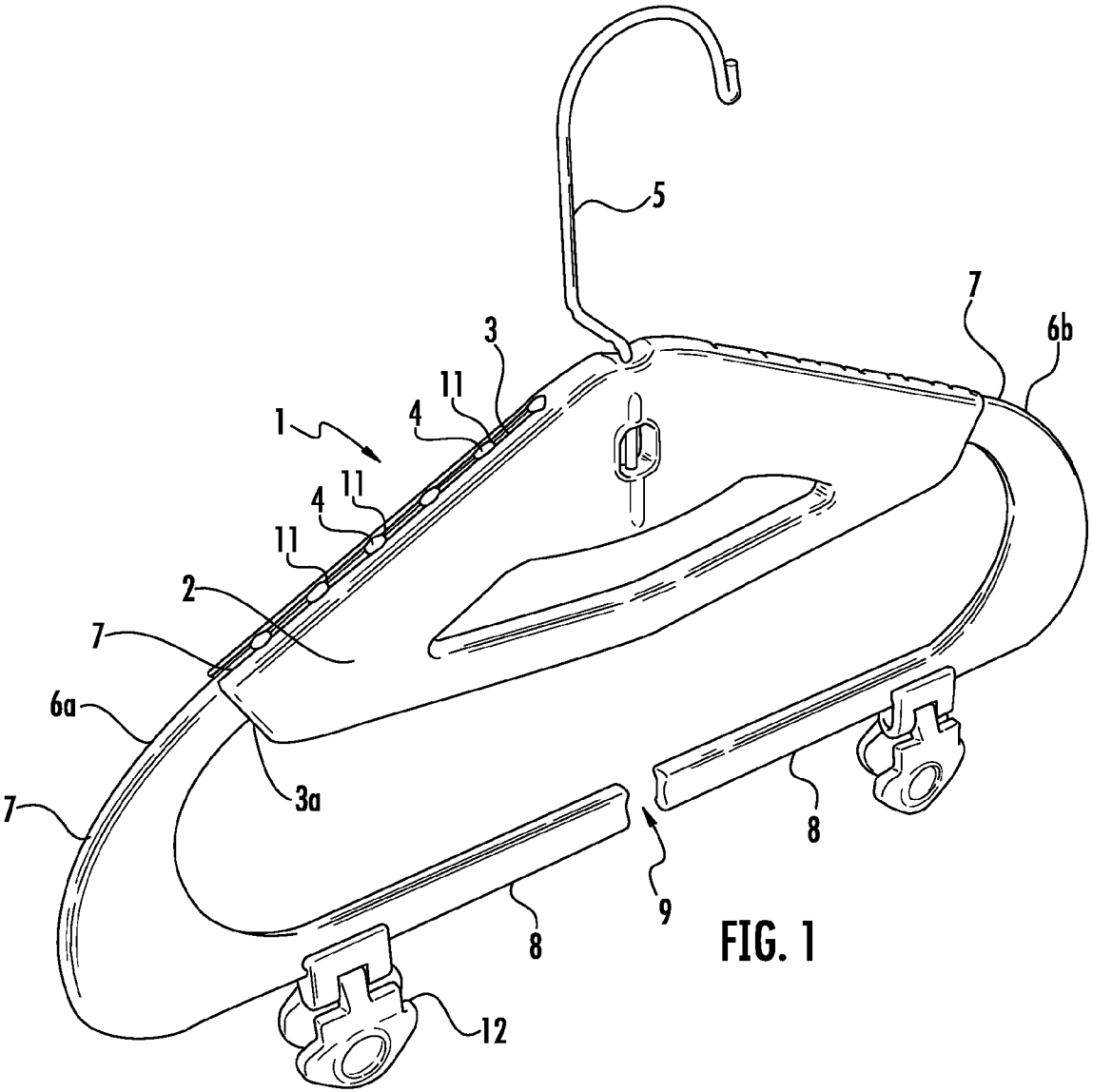
FIG. 1 is a frontal view of the present invention hanger.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "about" and "essentially" mean ±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the phrase "adjustable garment hanger" refers to a clothing hanger whose shoulders are adjustable in length and whose horizontal beam is adapted to widen and narrow to adapt to the adjustable shoulders. Hangers are generally triangular shaped devices for placing garments on and hanging them on a closet rod.

As used herein the term "yoke" is the apex area of a triangular shaped clothing/garment hanger. It is the part of the garment hanger to which the hook is attached to for suspending the hanger from a closet rod. Hangers can be fixed or rotatable. The particular yoke of the present invention has a left and right shoulder. Each shoulder is adapted with a slot on the shoulder along at least a portion of the length of each shoulder adapted at intervals to receive a plurality of locking buttons. The slot opens up into a hollow core which is adapted to receive a hanger section. The slot is easiest to see in the figures. In order to accept the locking buttons the surface portion of the slot is of a width narrower than the width of the buttons but at intervals there are widening portions (in one embodiment circular or matching the button shape) such that when a button reaches a widening portion the button locks in place with several buttons and when the buttons are repositioned a different length shoulder can be obtained as shown in the figures. The inside of the slot which is in the core of the shoulder can be wider than the surface of the slot and as noted adapted to receive the hanger sections of the hanger.

As used herein the term "buttons" refers to a surface nub, protrusion or the like which can be round or any shape as desired which can lock into an opening. It is designed to mate with the widening in the surface slot so it can lock in place in the slot. With a plurality of buttons, the buttons can be positioned in different openings positioned at the opening intervals as the slot widens. Once locked in place force will adjust the buttons position by sliding them to a narrower portion of the surface of the slot thus widening the slot allowing movement to different positions.

As used herein the "hanger section" refers to the portions together with the yoke that forms the triangle of the garment hanger. There is a left and right hanger section each having an angled shoulder beam and lower horizontal beam. The angled shoulder beam has a series of locking buttons position on its surface positioned at the same intervals as the adapted openings in the yoke such that the shoulder beam can be inserted in the slot and when the buttons line up in the slot the hanger is generally planer. The locking buttons allow for only the correct insertion orientation of the hanger section that is to be inserted. The receiving position in the slot on the yoke lock the shoulder in place wherein the angle beam can be positioned and locked at multiple positions by telescoping the shoulder beam within the slot to different positions such that the buttons lock in place. The shoulder can also, in one embodiment, be textured to help keep clothes from sliding off the shoulder of the hanger. This is especially a problem with very smooth fabrics such as silk. In one embodiment, it is a textured rubberized material.

The hanger sections each have a horizontal beam on the lower portion of the hanger section such that together the lower left and right horizontal sections form the horizontal beam used for hanging pants and the like on the hanger. The left and right horizontal beam do not lock together or otherwise mesh and are of a length that when at the hangers shortest position (the shoulder beam all the way in the slot) the horizontal beams still do not touch or barely touch (do not deform because they are pushing on one another).

The hanger can have optional additional devices added onto the hanger such as clips for holding skirts and pants and the like positioned on the horizontal beams or as desired on the hanger. In other embodiments, the left and right shoulder section, the yoke or the horizontal beams can be coated to increase friction thus preventing material such as silk from sliding off the hangar. In one embodiment, the material for increasing friction is a rubberized material, smooth or textured such as rubber, vinyl, foam rubber, fabric and the like.

Now referring to the drawings, FIG. 1 is a frontal view of the present invention hanger with the hanger configured in its narrowest configuration. The hanger 1 consists of yoke 2 having a slot 3 with openings to receive buttons 4 along the slot 3. The slot has a central core 3*a* for receiving the hanger section. A hook 5 is positioned upright in the yoke 2 for hanging the hanger on the closet bar. A left 6*a* and right 6*b* hanger section is shown. The hanger section has a shoulder beam 7 and horizontal beam 8 which as noted in this picture do not touch at their closest forming gap 9. The shoulder beam 7 has a series of locking buttons 4 for locking in slot openings 11 when inserted into yoke slot central core 3*a*. Optional spring-loaded pants clips 12 are seen attached to the horizontal beams 8 but magnetic clips also could be used.

Figure 2:
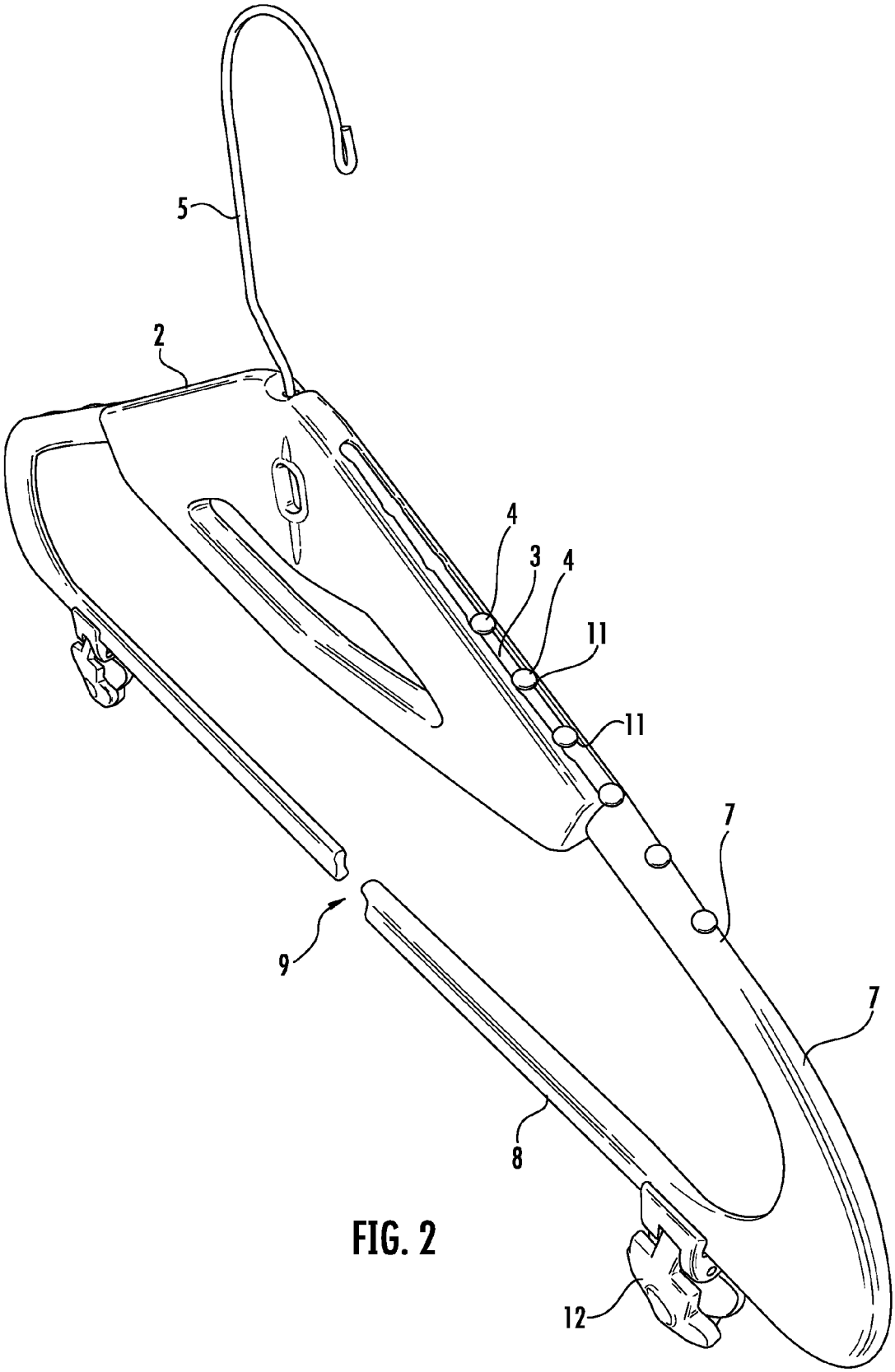
FIG. 2 is a perspective view of the present invention hanger with the hanger sections extended.
Figure 3:
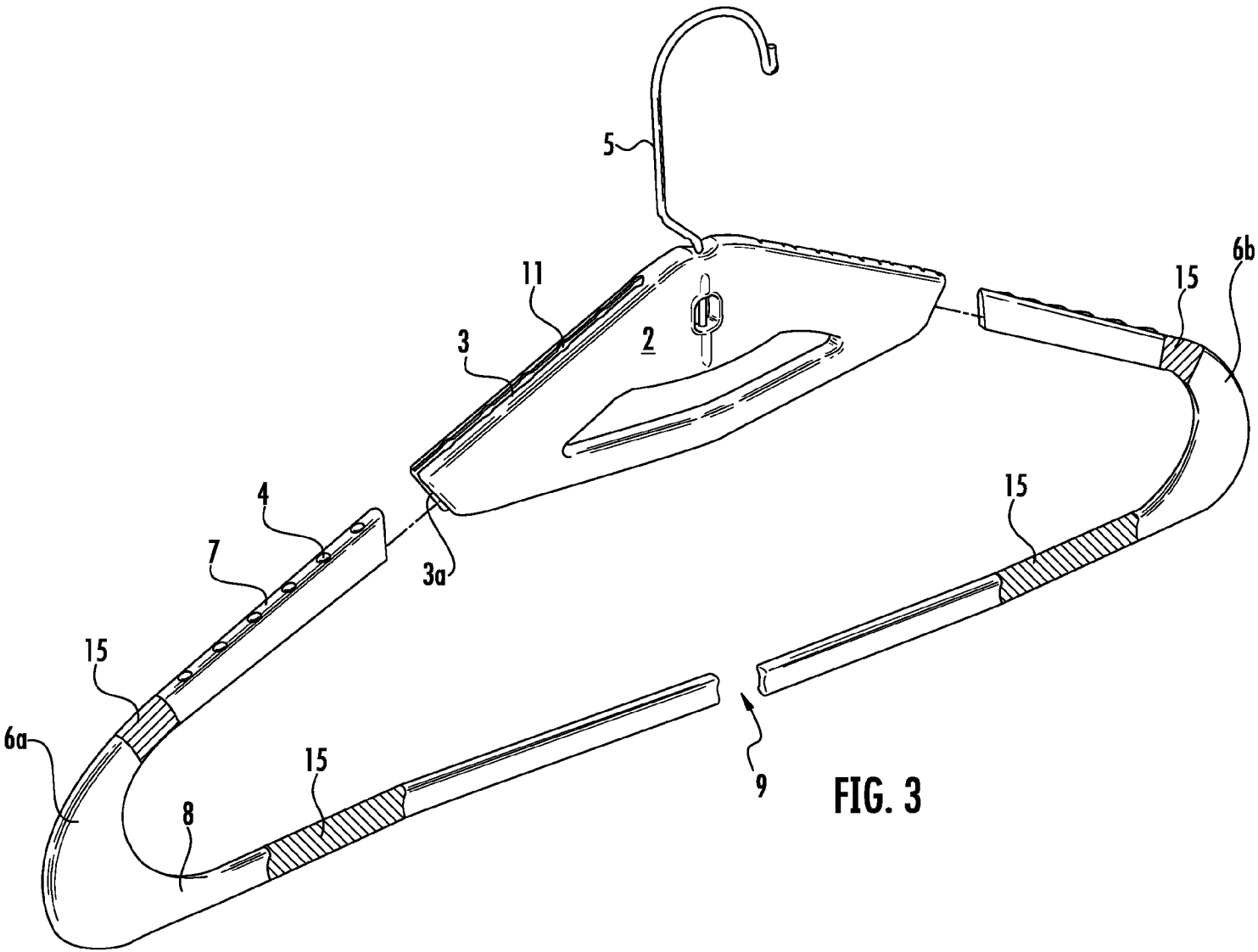
FIG. 3 is an exploded view of the present invention hanger.

FIG. 2 is a perspective view of the present invention hanger with the hanger sections extended to a wide shoulder position. FIG. 3 is an exploded view of the present invention hanger. In this view a rubberized material 15 (optionally textured) is added to the shoulder 6*a*, 6*b* and horizontal beam 8. All numbers are the same in each figure for comparison.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. An adjustable garment hanger comprising:

a) a yoke, having an angled left and right shoulder, each shoulder having a central core and a slot along at least a portion of the length of each angled shoulder and the slot adapted at intervals to receive a plurality of friction fit locking buttons;

b) a left and right hanger section, each hanger section having an angled shoulder beam and a lower horizontal beam, the angled shoulder beam having a series of fixed locking buttons positioned at the same intervals as the adaptation in the yoke such that the shoulder beam can be placed in the central core and the locking buttons aligned with the receiving positions on the yoke to lock the shoulder in place wherein the angled beam can be positioned and locked at multiple positions by telescoping within the central core to adjust the length of the shoulder created by the yoke and hanger section;

c) wherein the length of the horizontal beam on each of the left and right hanger section is of a length such that when the created shoulder is at its shortest either do not touch or touch without deforming the horizontal nature of the horizontal beams and move apart from one another and are not touching when the created shoulder is not at its shortest and wherein the horizontal beams are not connected; and d) a hook which depends from the yoke such that the hanger can be suspended from a horizontal closet rod.

2. The adjustable garment hanger according to claim 1 which further comprises one or more clips suspended from at least one of the left or right hanger section.

* * * * *